US008026657B2

(12) United States Patent
Li et al.

(10) Patent No.: US 8,026,657 B2
(45) Date of Patent: Sep. 27, 2011

(54) ELECTRON EMISSION LIGHT-EMITTING DEVICE AND LIGHT EMITTING METHOD THEREOF

(75) Inventors: Jung-Yu Li, Yonghe (TW); Shih-Pu Chen, Hsinchu (TW); Yi-Ping Lin, Lugang Township, Changhua County (TW); Wei-Chih Lin, Sanchong (TW); Lian-Yi Cho, Jhunan Township, Miaoli County (TW)

(73) Assignee: Industrial Technology Research Institute, Hsinchu (TW)

( * ) Notice: Subject to any disclaimer, the term of this patent is extended or adjusted under 35 U.S.C. 154(b) by 599 days.

(21) Appl. No.: 11/958,391

(22) Filed: Dec. 18, 2007

(65) Prior Publication Data

US 2008/0143238 A1 Jun. 19, 2008

Related U.S. Application Data

(63) Continuation-in-part of application No. 11/674,159, filed on Feb. 13, 2007, now abandoned.

(30) Foreign Application Priority Data

Dec. 18, 2006 (TW) ..... 95147427 A
Aug. 7, 2007 (TW) ..... 96128992 A

(51) Int. Cl.
*H01J 63/04* (2006.01)

(52) U.S. Cl. ..... 313/491; 313/485

(58) Field of Classification Search ..... 313/495–498, 313/483–485, 491
See application file for complete search history.

(56) References Cited

U.S. PATENT DOCUMENTS

| | | | | |
|---|---|---|---|---|
| 6,097,138 | A | 8/2000 | Nakamoto | |
| 6,346,775 | B1 * | 2/2002 | Lee et al. | 315/169.3 |
| 6,629,869 | B1 | 10/2003 | Xie et al. | |
| 2003/0001492 | A1 | 1/2003 | Pei et al. | |
| 2003/0098643 | A1 * | 5/2003 | Park et al. | 313/495 |
| 2003/0178934 | A1 | 9/2003 | Jeong et al. | |
| 2004/0192153 | A1 | 9/2004 | Liu et al. | |
| 2005/0017648 | A1 | 1/2005 | Naaman et al. | |
| 2005/0099137 | A1 * | 5/2005 | Park et al. | 315/160 |
| 2006/0158454 | A1 | 7/2006 | Heynderickx et al. | |

(Continued)

FOREIGN PATENT DOCUMENTS

CN 1111783 11/1995

(Continued)

OTHER PUBLICATIONS

"1st Office Action of China counterpart application", issued on May 8, 2009, p. 1-p. 7.

(Continued)

*Primary Examiner* — Bumsuk Won
*Assistant Examiner* — Brenitra Lee
(74) *Attorney, Agent, or Firm* — Jianq Chyun IP Office

(57) ABSTRACT

An electron emission light-emitting device includes a cathode structure, an anode structure, a fluorescent layer, and a low-pressure gas layer. The fluorescent layer is located between the cathode structure and the anode structure. The low-pressure gas layer is filled between the cathode structure and the anode structure, having a function of inducing the cathode to emit electron uniformly. The low-pressure gas layer has an electron mean free path, allowing at least sufficient amount of electrons to directly impinge the fluorescent layer under an operation voltage.

16 Claims, 8 Drawing Sheets

U.S. PATENT DOCUMENTS

2007/0262694 A1* 11/2007 Mikoshiba et al. ..... 313/483

FOREIGN PATENT DOCUMENTS

| | | |
|---|---|---|
| CN | 1480977 | 3/2004 |
| CN | 1618113 | 5/2005 |
| CN | 1794399 | 6/2006 |
| CN | 1875665 | 12/2006 |
| EP | 1628325 | 2/2006 |
| EP | 1684321 | 7/2006 |
| EP | 1691585 | 8/2006 |
| JP | 05-047297 | 2/1993 |
| JP | 08-031303 | 2/1996 |
| JP | 09-179106 | 7/1997 |
| JP | 10-116555 | 5/1998 |
| JP | 2004-146364 | 5/2004 |
| JP | 2005-513732 | 5/2005 |
| JP | 2005-216704 | 8/2005 |
| JP | 2005-310647 | 11/2005 |
| JP | 2006-164938 | 6/2006 |
| JP | 4124785 | 5/2008 |
| KR | 1998-80595 | 11/1998 |
| KR | 1020040011856 | 2/2004 |
| TW | 494425 | 7/2002 |
| TW | 523725 | 3/2003 |
| TW | 564454 | 12/2003 |
| TW | 588388 | 5/2004 |
| TW | 200609342 | 3/2006 |
| TW | 200629333 | 8/2006 |
| TW | I265356 | 11/2006 |
| WO | 03-054902 | 7/2003 |

OTHER PUBLICATIONS

"1st Office Action of Chinese counterpart application", issued on Jun. 26, 2009, p. 1-p. 7.

"1st Office Action of US co-pending Application", issued on Mar. 8, 2010, p. 1-p. 32, in which US20060158454 was cited.

"Final Office Action of US co-pending Application", issued on Aug. 16, 2010, p. 1-p. 21, in which US20030178934 was cited.

"2nd Office Action of China counterpart application", issued on Sep. 11, 2009, p. 1-p. 8 .

Yuan Cheng & Otto Zhou, Electron field emission from carbon nanotubes, C. R. Physique 4(2003) 1021-1033.

"Office Action of Japan Counterpart Application", issued on Jan. 11, 2011, p. 1-p. 3, in which the listed references were cited.

"Office Action of Japan Counterpart Application", issued on Apr. 5, 2011, p. 1-p. 2, in which the listed references JP2005-513732 and JP4124785 were cited.

"Office Action of Taiwan Counterpart Application", issued on Apr. 12, 2011, p. 1-p. 6, in which the other listed references were cited.

"Office Action of Taiwan Counterpart Application", issued on May 12, 2011, p. 1-p. 7, in which the listed references were cited.

"Office Action of Taiwan counterpart application", issued on Jul. 4, 2011, p.1-p.5, in which the cited references were cited.

* cited by examiner

ELECTRON EMISSION LIGHT-EMITTING DEVICE AND LIGHT EMITTING METHOD THEREOF

CROSS-REFERENCE TO RELATED APPLICATION

This application is a continuation-in-part of a prior U.S. application Ser. No. 11/674,159, filed on Feb. 13, 2007, and also claims the priority benefit of Taiwan application serial no. 96128992, filed on Aug. 7, 2007. The U.S. application Ser. No. 11/674,159 claims the priority benefit of Taiwan application serial no. 95147427, filed on Dec. 18, 2006. The entirety of each of the above-mentioned patent applications is incorporated herein by reference and made a part of this specification.

BACKGROUND OF THE INVENTION

1. Field of the Invention

The present invention generally relates to a light-emitting device, in particular, to an electron emission light emitting method and device, and applications thereof.

2. Description of Related Art

Currently, mass-produced light source apparatus or display apparatus mainly employ two types of light-emitting structures, which are described as follows.

1. Gas-discharge light sources: the gas-discharge light sources are applicable to, for example, plasma panels or gas-discharge lamps, for ionizing the gas filled in a discharge chamber by the use of an electric field between a cathode and an anode, such that electrons impinge the gas by means of glow discharge to generate transition and emit ultraviolet (UV) lights. And, a fluorescent layer located in the same discharge chamber absorbs the UV lights to emit visible lights.
2. Field emission light source: the field emission light source are applicable to, for example, carbon nanotube field emission display, for providing an ultra high vacuum environment, and an electron emitter made of a carbon nanomaterial is fabricated on a cathode, so as to help the electrons to overcome the work function of the cathode to depart from the cathode by the use of the microstructure of high aspect ratio in the electron emitter. Moreover, a fluorescent layer is coated on an anode made of indium tin oxide (ITO), such that the electrons escape from the carbon nanotube of the cathode due to a high electric field between the cathode and the anode. Therefore, the electrons impinge the fluorescent layer on the anode in the vacuum environment, so as to emit visible lights.

However, the above two types of light-emitting structures have disadvantages. For example, the attenuation occurs after the irradiation of the UV lights, so that specific requirements must be taken into account in selecting the material in the gas-discharge light source. Moreover, the gas-discharge light-emitting mechanism emits the visible lights through two processes, so that more energy is consumed, and if the plasma must be generated in the process, more electricity is consumed. On the other hand, the field emission light source requires a uniform electron emitter to be grown or coated on the cathode, but the mass production technique of this type of cathode structure is not mature, and the uniformity and a poor production yield of the electron emitter are still bottlenecks. Further, a distance between the cathode and the anode of the field emission light source must be accurately controlled, and the ultra high vacuum packaging is quite difficult and also increases the fabrication cost.

SUMMARY OF THE INVENTION

Accordingly, the present invention is directed to a light emitting method having good light emitting efficiency, and applicable to easily fabricate an electron emission light-emitting device.

The present invention is further directed to a light source apparatus using the electron emission light-emitting device, for providing a good and uniform light source, and having lower fabrication cost and better production yield.

The present invention is further directed to a display apparatus using the electron emission light-emitting device as a display pixel, for providing a good display quality, and reducing the cost and complexity in fabrication.

As embodied and broadly described herein, an electron emission light emitting method is provided, which is applicable to a device including a cathode structure, an anode structure, and a fluorescent layer. The method includes filling a low-pressure gas layer between the cathode structure and the anode structure, so as to induce the cathode to emit electrons uniformly to impinge the fluorescent layer.

The present invention further provides an electron emission light-emitting device, which includes a cathode structure; an anode structure; a fluorescent layer located between the cathode structure and the anode structure; and a low-pressure gas layer filled between the cathode structure and the anode structure, for inducing the cathode to emit electrons uniformly.

The present invention further provides an electron emission light-emitting device, which includes a cathode structure; an anode structure; an induced discharge structure layer located on at least one of the cathode structure and the anode structure; a fluorescent layer located between the cathode structure and the anode structure; and a low-pressure gas layer filled between the cathode structure and the anode structure, for inducing the cathode to emit electrons uniformly.

The present invention further provides an electron emission light-emitting device, which includes a substrate; at least one cathode structure disposed on the substrate; at least one anode structure disposed on the substrate; a fluorescent layer disposed on the substrate and located between the at least one cathode structure and the at least one anode structure; and a low-pressure gas layer filled between the at least one cathode structure and the at least one anode structure, for inducing the cathode to emit electrons uniformly.

In view of the above, the present invention uses a thin gas to easily induce electrons from the cathode, thus avoiding possible problems resulting from fabricating the electron emitter on the cathode. Moreover, as the gas is thin, the electrons have a large mean free path allowing most electrons to directly react with the fluorescent layer to emit light before colliding the gas. In other words, the electron emission light-emitting device of the present invention has a higher light emitting efficiency, is easy to fabricate, and has a better production yield.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
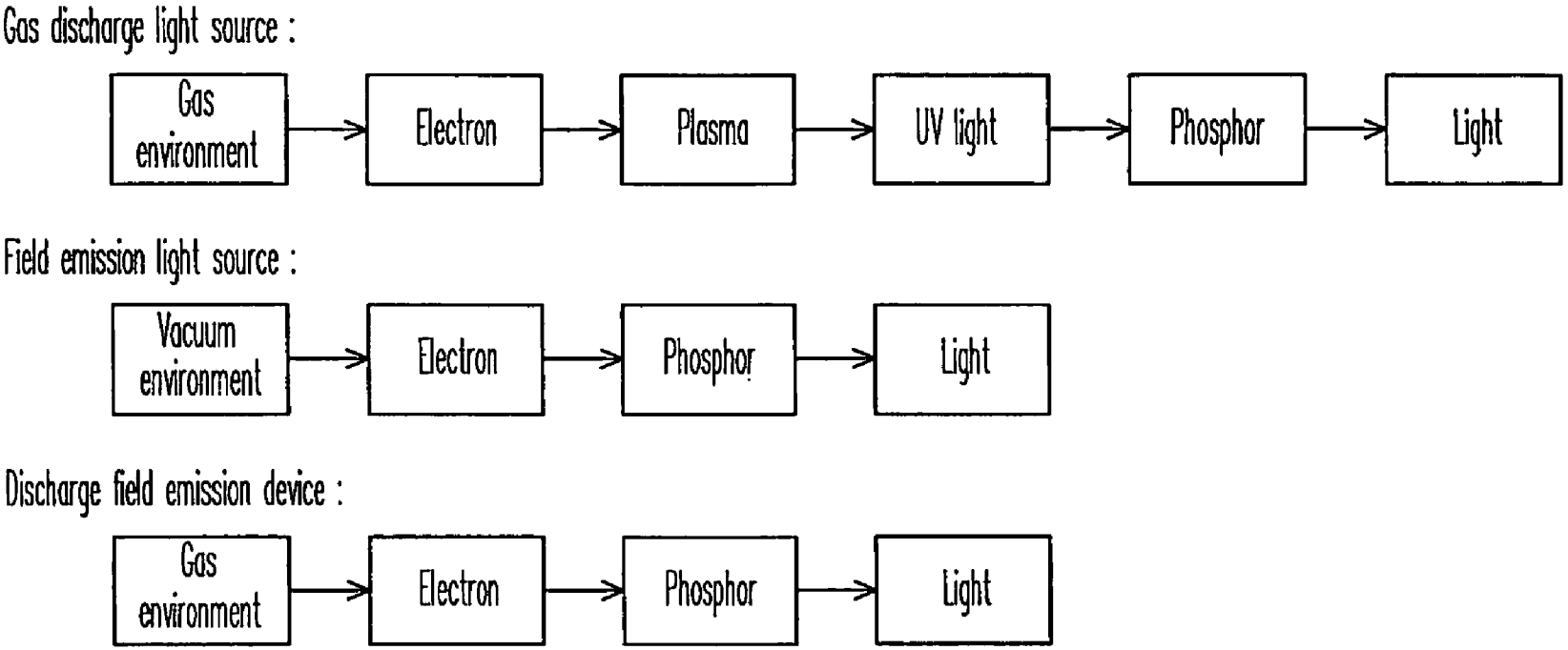
FIG. 1 is a schematic view illustrating a comparison between the light-emitting mechanisms of a conventional light-emitting structure and an electron emission light-emitting device of the present invention.

Reference will now be made in detail to the present embodiments of the invention, examples of which are illustrated in the accompanying drawings. Wherever possible, the same reference numbers are used in the drawings and the description to refer to the same or like parts.

The electron emission light-emitting device provided by the present invention has the advantages of the conventional gas-discharge light source and field emission light source, and overcomes the disadvantages of the above two conventional light-emitting structures. Referring to FIG. 1, a schematic view illustrating a comparison between light-emitting mechanisms of two conventional light-emitting structures and the electron emission light-emitting device of the present invention is shown. In detail, the conventional gas glow discharge light source utilizes an electric field between the cathode and the anode to ionize the gas filled in a discharge chamber, such that the electrons impinge other gas molecules by means of gas conduction so as to generate the UV lights, and a fluorescent layer absorbs the UV lights to generate the visible lights. Moreover, the conventional field emission light source helps the electrons to overcome the work function of the cathode to apart from the cathode in an ultra high vacuum environment by the use of the high aspect ratio structure of the electron emitter on the cathode. Thereafter, the electrons escape from the electron emitter of the cathode due to the high electric field between the cathode and the anode, and impinge the fluorescent layer on the anode, so as to emit the visible lights. In other words, the material of the fluorescent layer may be a material capable of emitting visible lights, infrared lights, or UV lights, depending on the requirements of design mechanism.

Different from the above two conventional light-emitting mechanisms, the electron emission light-emitting device of the present invention uses a thin gas instead of the electron emitter to easily induce the electrons from the cathode, such that the electrons directly react with the fluorescent layer to emit light rays.

Comparing with the conventional gas glow discharge light source, the amount of the gas filled in the electron emission light-emitting device of the present invention is only required to be enough for inducing the electrons from the cathode, while light rays are not generated by using UV lights to irradiate the fluorescent layer. Therefore, the attenuation of the material in the device caused by the irradiation of the UV lights will not occur. Experiments and theories verify that that the gas in the electron emission light-emitting device of the present invention is thin, and thus the mean free path of the electrons can be up to about 5 mm or above. In other words, most electrons directly impinge the fluorescent layer to emit light rays before impinging the gas molecules. Moreover, the electron emission light-emitting device of the present invention does not need to generate light rays through two processes, thus having higher light emitting efficiency and reducing the power consumption.

On the other hand, the conventional field emission light source requires forming the microstructure serving as the electron emitter on the cathode, and the microstructure is difficult to control in mass production process. The most common microstructure is carbon nanotube, but when coated on the cathode, problems of different tube lengths and gathering into clusters are generated, and thus a light emitting surface has dark spots and the light emission uniformity is unsatisfactory, which are the technical bottlenecks and main costs of the field emission light source. The electron emission light-emitting device of the present invention is capable of inducing the electrons uniformly from the cathode by the use of gas, and only a simple cathode planar structure is used to achieve 75% light emission uniformity for the electron emission light-emitting panel, thus solving the bottleneck of the conventional field emission light-emitting apparatus that the light emission uniformity is difficult to improve. Therefore, the fabrication cost can be significantly saved, and the process is simpler. Moreover, the electron emission light-emitting device of the present invention is filled with the thin gas, so the ultra high vacuum environment is not required, thus avoiding the difficulties encountered during the ultra high vacuum packaging. Furthermore, the experiment results show that the electron emission light-emitting device of the present invention can reduce a turn on voltage to about 0.4 V/μm with the help of the gas, which is much lower than the turn on voltage of up to 1-3 V/μm of the common field emission light source.

Further, based on the Child-Langmuir equation, after substituting the practical relevant data of the electron emission light-emitting device of the present invention into the equation, it can be calculated that the distribution of a dark region of the cathode of the electron emission light-emitting device of the present invention ranges from about 10 cm to 25 cm, which is much greater than the distance between the anode and the cathode. In other words, the electron emission light-emitting device of the present invention uses the gas to induce the electrons of the cathode, and the electrons directly react with the fluorescent layer to emit lights.

Figure 2:
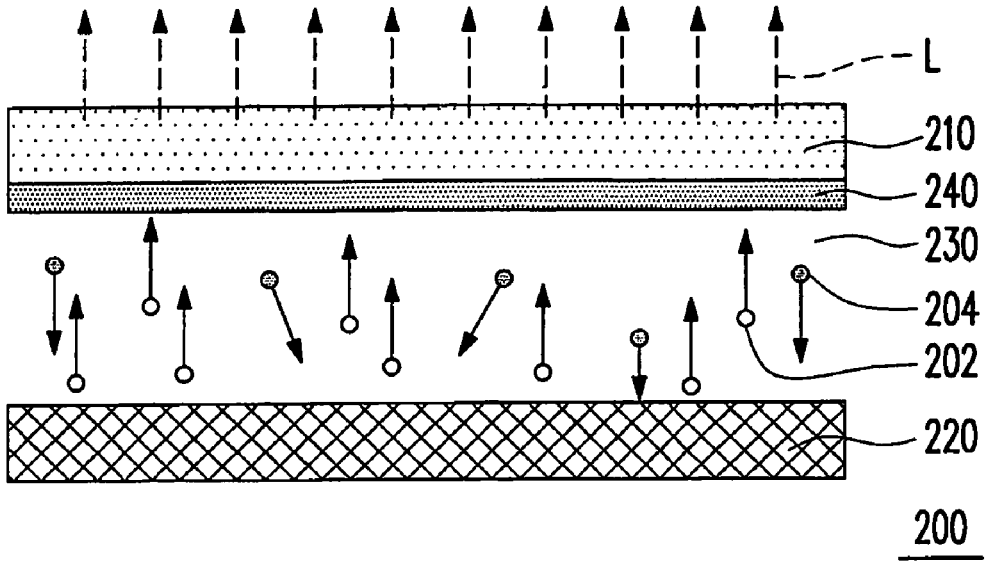
FIG. 2 schematically shows a basic architecture of the electron emission light-emitting device of the present invention.

FIG. 2 shows a basic architecture of the electron emission light-emitting device of the present invention. Referring to FIG. 2, the electron emission light-emitting device 200 mainly includes an anode 210, a cathode 220, a gas 230, and a fluorescent layer 240. The gas 230 is located between the anode 210 and the cathode 220, and the gas 230 generates proper amount of positive ions 204 under an electric field, for inducing the cathode 220 to emit a plurality of electrons 202. It should be noted that an ambient gas pressure of the gas 230 of the present invention is between $8\times10^{-1}$ torr and $10^{-3}$ torr, and preferably between $2\times10^{-2}$ torr and $10^{-3}$ torr or between $2\times10^{-2}$ torr and $1.5\times10^{-1}$ torr. Moreover, the fluorescent layer 240 is disposed on a move path of the electrons 202, so as to react with the electrons 202 to emit lights L.

In this embodiment, the fluorescent layer 240 is, for example, coated on a surface of the anode 210. In addition, the anode 210 is, for example, made of a transparent conductive oxide (TCO), such that the lights L pass through the anode 210 and emerge from the electron emission light-emitting device 200. The transparent conductive oxide may be a common material, for example, selected from indium tin oxide (ITO), F-doped tin oxide (FTO), or indium zinc oxide (IZO). Definitely, in other embodiments, the anode 210 or the cathode 220 may also be made of a metal or other materials with good conductivity.

The gas 230 used in the present invention has no special requirements on the property, and may be an inert gas such as $N_2$, He, Ne, Ar, Kr, Xe, or a gas such as $H_2$ and $CO_2$ having good conductivity after ionization, or a common gas such as $O_2$ and air. In addition, by selecting the type of the fluorescent layer 240, the electron emission light-emitting device 200 can emit different types of lights, such as visible lights, infrared lights, or UV lights.

In addition, the so-called cathode and anode indicate two voltage sources of a low voltage and a high voltage respectively, so as to generate required operation voltage difference or corresponding electric field intensity. Therefore, generally speaking, the anode 210 applies a positive voltage, and the cathode 220 applies a ground voltage. However, the anode 210 can also apply a ground voltage, and the cathode 220 can also apply a negative voltage, which also achieves the light emitting effect. In addition, the pressure of the low-pressure gas is also related to the operation voltage. During the practical design, the proper conditions of the gas pressure and the operation voltage may be selected. Experiments verify that for example, desired light source may be emitted under the conditions that the anode is at about 0 V, the cathode is at about −7 KV, the distance between the cathode and the anode is >2 cm, and the low-pressure gas is about $2\times10^{-2}$ torr, or under the conditions that the anode is at about 0 V, the cathode has the operation voltage of about −7 KV, the distance between the cathode and the anode is equal to 1 cm, and the low-pressure gas is about $1.3\times10^{-1}$ torr. However, no light is emitted if the low-pressure gas is $1.2\times10^{-4}$ torr, and the practical gas pressure and operation voltage change according to different distances between the cathode and anode, gas categories, and structures.

Generally speaking, different from the cathode having a tip structure, the cathode designed to be a metal plate cannot easily induce the electron, and if the voltage is too low or the gas pressure is too low, the field emission effect cannot be induced to generate sufficient lights, or even no lights.

Figure 3:
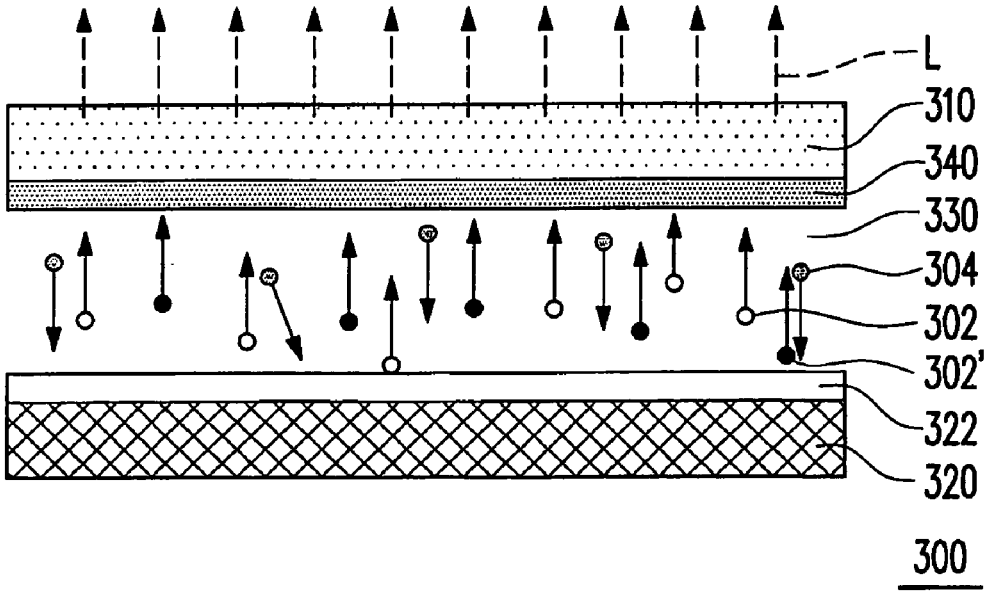
FIG. 3 schematically shows an electron emission light-emitting device according to another embodiment of the present invention.

In addition to the embodiment in FIG. 2, for improving the light emitting efficiency, the present invention further forms a material which is easy to generate the electrons on the cathode, so as to provide an additional electron source. In an electron emission light-emitting device 300 according to another embodiment of the present invention as shown in FIG. 3, a cathode 320 is, for example, formed with a secondary electron source material layer 322. The secondary electron source material layer 322 may be made of a material such as MgO, $Tb_2O_3$, $La_2O_3$, or $CeO_2$. The gas 330 generates ionized ions 304, and the ions 304 with positive charges move towards the cathode 320 away from the anode 310, so when the ions 304 impinge the secondary electron source material layer 322 on the cathode 320, additional secondary electrons 302' are generated. More electrons (including the original electrons 302 and the secondary electrons 302') react with the fluorescent layer 340 and generates more ionized ions 304, which helps to increase the light emitting efficiency and discharge stability. It should be noted that, the secondary electron source material layer 322 cannot only help to generate the secondary electrons, but also protect the cathode 320 from being over-bombarded by the ions 304.

Figure 4A:
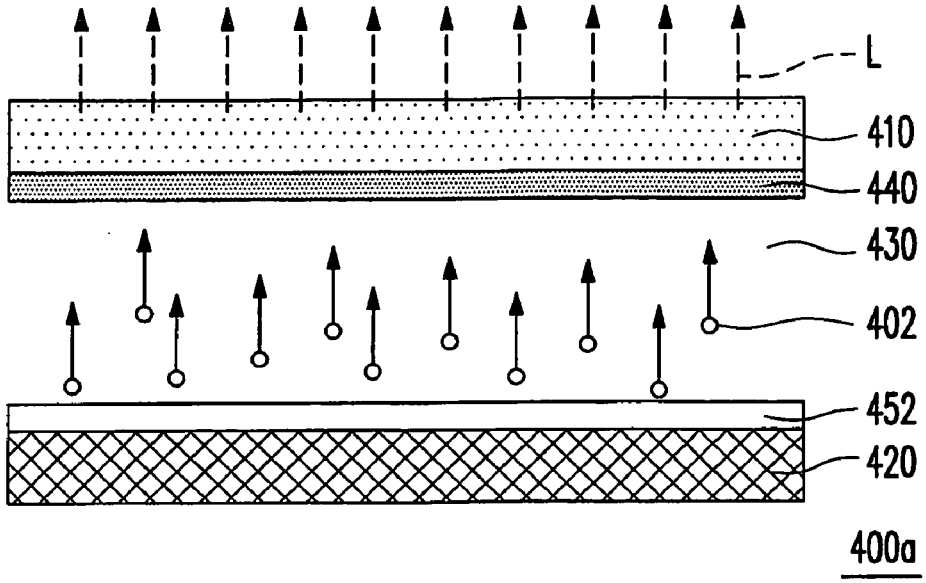
FIGS. 4A to 4C schematically show various electron emission light-emitting devices having induced discharge structures of the present invention.
Figure 4B:
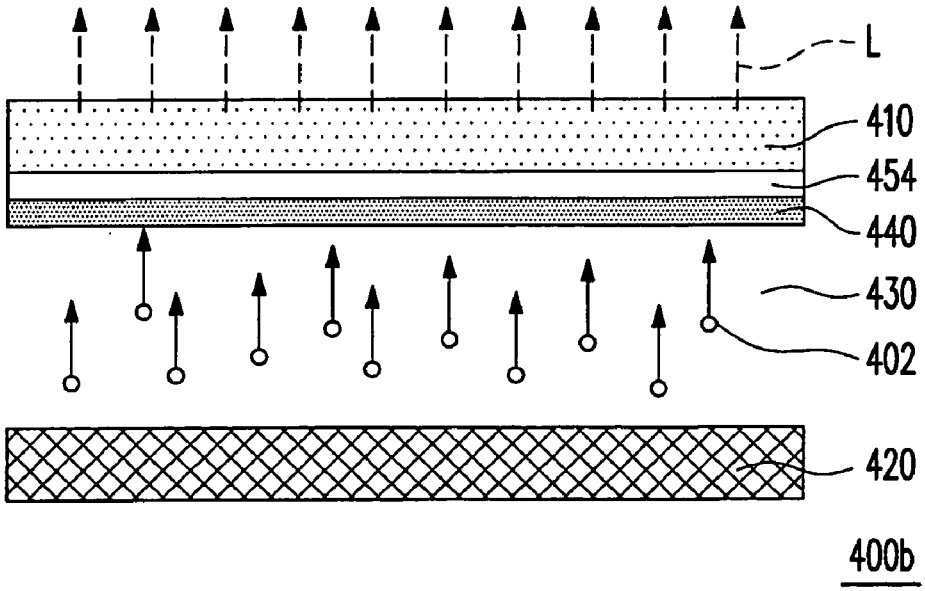
Figure 4C:
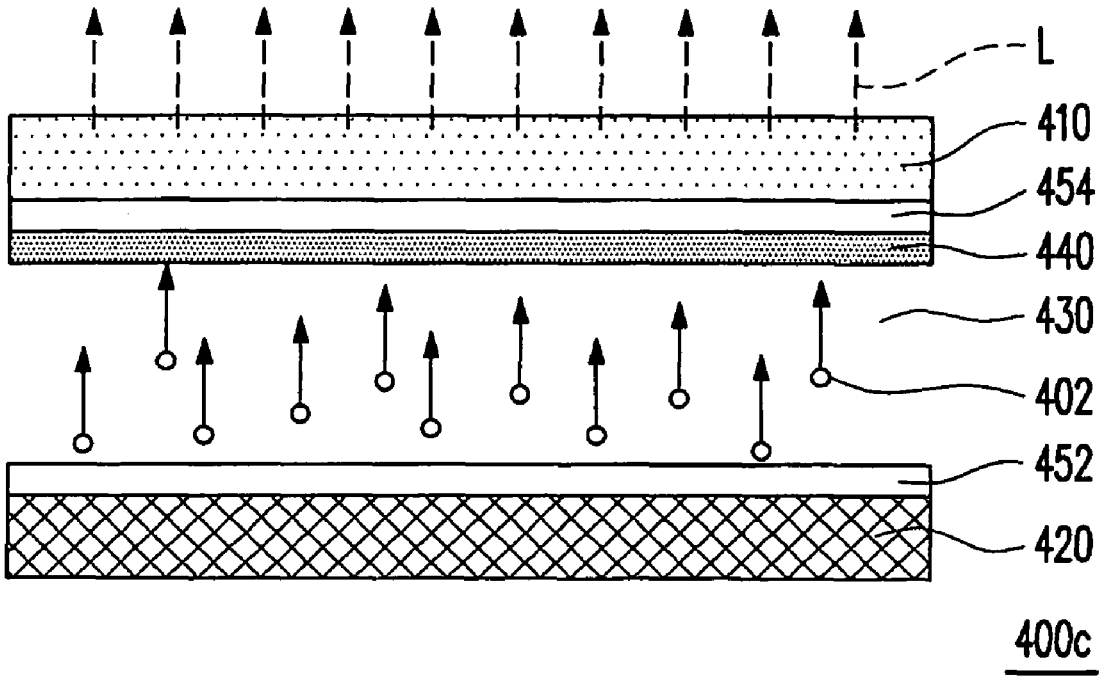

Further, the present invention can form a structure similar to the electron emitter of the field emission light source on the anode or the cathode or both, so as to reduce the working voltage on the electrode to generate electrons more easily. FIGS. 4A to 4C show various electron emission light-emitting devices having induced discharge structures of the present invention, in which like elements are indicated by the same numbers, and will not be described again below.

Referring to FIG. 4A, an induced discharge structure 452 is formed on a cathode 420 of an electron emission light-emitting device 400*a*, and the induced discharge structure 452 is, for example, a microstructure made of a material such as a metal material, a carbon nanotube, a carbon nanowall, a carbon nanoporous, a diamond film, a ZnO column, and ZnO. The induced discharge structure 452 may also be added with the aforementioned secondary electron source material layer. Moreover, a gas 430 is located between an anode 410 and the cathode 420, and a fluorescent layer 440 is disposed on a surface of the anode 410. A working voltage between the anode 410 and the cathode 420 may be reduced by the induced discharge structure 452, so as to generate electrons 402 more easily. The electrons 402 react with the fluorescent layer 440 to generate lights L.

An electron emission light-emitting device 400*b* in FIG. 4B is similar to that in FIG. 4A, and a distinct difference lies in that an induced discharge structure 454 is disposed on the anode 410, and as mentioned above, the induced discharge structure 454 may be a microstructure made of a material such as a metal material, a carbon nanotube, a carbon nanowall, a carbon nanoporous, a diamond film, a ZnO column, and ZnO. Also, the induced discharge structure 454 may also be added with the aforementioned secondary electron source material layer. In addition, the fluorescent layer 440 is disposed on the induced discharge structure 454.

FIG. 4C shows an electron emission light-emitting device 400*c* including the induced discharge structures 454 and 452, in which the induced discharge structure 454 is disposed on the anode 410, the fluorescent layer 440 is disposed on the induced discharge structure 454, and the induced discharge structure 452 is disposed on the cathode 420. The gas 430 is located between the anode 410 and the cathode 420.

The various electron emission light-emitting devices 400*a*, 400*b*, or 400*c* having the induced discharge structure(s) 452 and/or 454 may be integrated with the design of the secondary electron source material layer 322 as shown in FIG. 3, so as to form the secondary electron source material layer on the cathode 420. If the cathode 420 is formed with the induced discharge structure 454, the secondary electron source material layer then covers the induced discharge structure 454. Therefore, not only the working voltage between the anode 410 and the cathode 420 is reduced to generate the electrons 402 more easily, and the light emitting efficiency may also be improved by increasing the amount of the electrons 402 through the secondary electron source material layer.

In addition to the parallel plate structure, the electron emission light-emitting device provided by the present invention may serve as a light-emitting structure and have different shapes.

Figure 5:
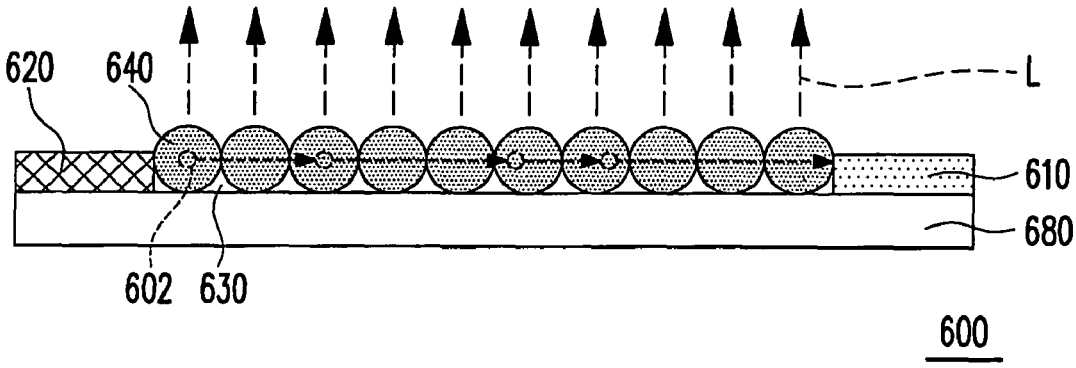
FIG. 5 schematically shows an in-plane emission type light-emitting structure according to an embodiment of the present invention.

Firstly, FIG. 5 shows another in-plane emission type light-emitting structure 600. An anode 610, a cathode 620, and a fluorescent layer 640 are disposed on a substrate 680, for example, on the same side of the substrate 680. The substrate 680 is, for example, a glass substrate, and the material of the anode 610 and the cathode 620 is, for example, a metal. The fluorescent layer 640 is located between the anode 610 and the cathode 620, and electrons 602 induced by a gas 630 penetrate the fluorescent layer 640 to emit lights L. The description of other devices is illustrated in the above embodiments and will not be described herein again. Also, the closed environment of the gas 630 may be achieved through a common technology, and the details thereof will not be described herein.

It should be noted that the light-emitting structure of FIG. 5 is only described for illustration, instead of limiting the shape of the light-emitting structure in the present invention. In other embodiments, for example, the above light-emitting structure may be combined with the secondary electron source material layer 322 of FIG. 3 or the induced discharge structures 452 and 454 of FIGS. 4A to 4C depending on different considerations, so as to meet different requirements.

Figure 6:
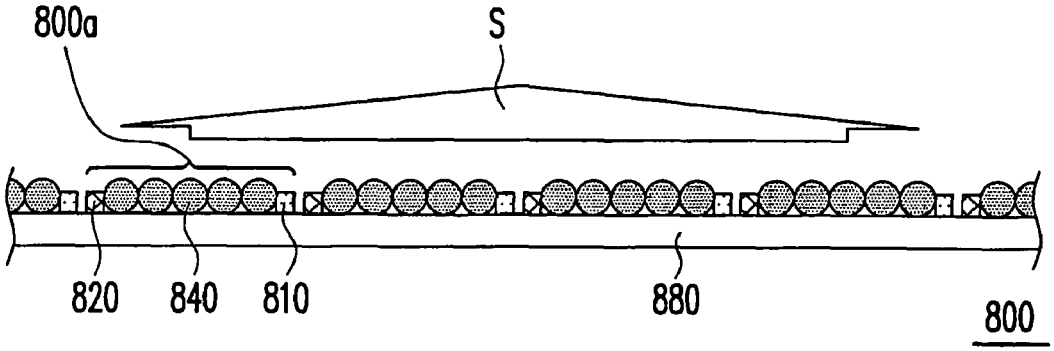
FIG. 6 schematically shows a light source apparatus according to an embodiment of the present invention.

The electron emission light-emitting device of the present invention may be used to fabricate a light source apparatus, which is composed of, for example, any type of electron emission light-emitting device in the above several embodiments, so as to provide a light source. FIG. 6 shows a light source apparatus according to an embodiment of the present invention. Referring to FIG. 6, a light source apparatus 800 includes a plurality of electron emission light-emitting devices 800*a* arranged in an array, for providing a surface light source S. The design of the electron emission light-emitting device 800*a* selected in this embodiment includes, for example, any one of the above several embodiments. For example, the light source apparatus 800 can use a design similar to the light-emitting structure 600 of FIG. 6, and fabricate several sets of anodes 810, cathodes 820, and fluorescent layers 840 on a substrate 880, so as to achieve the large scale purpose.

Figure 7:
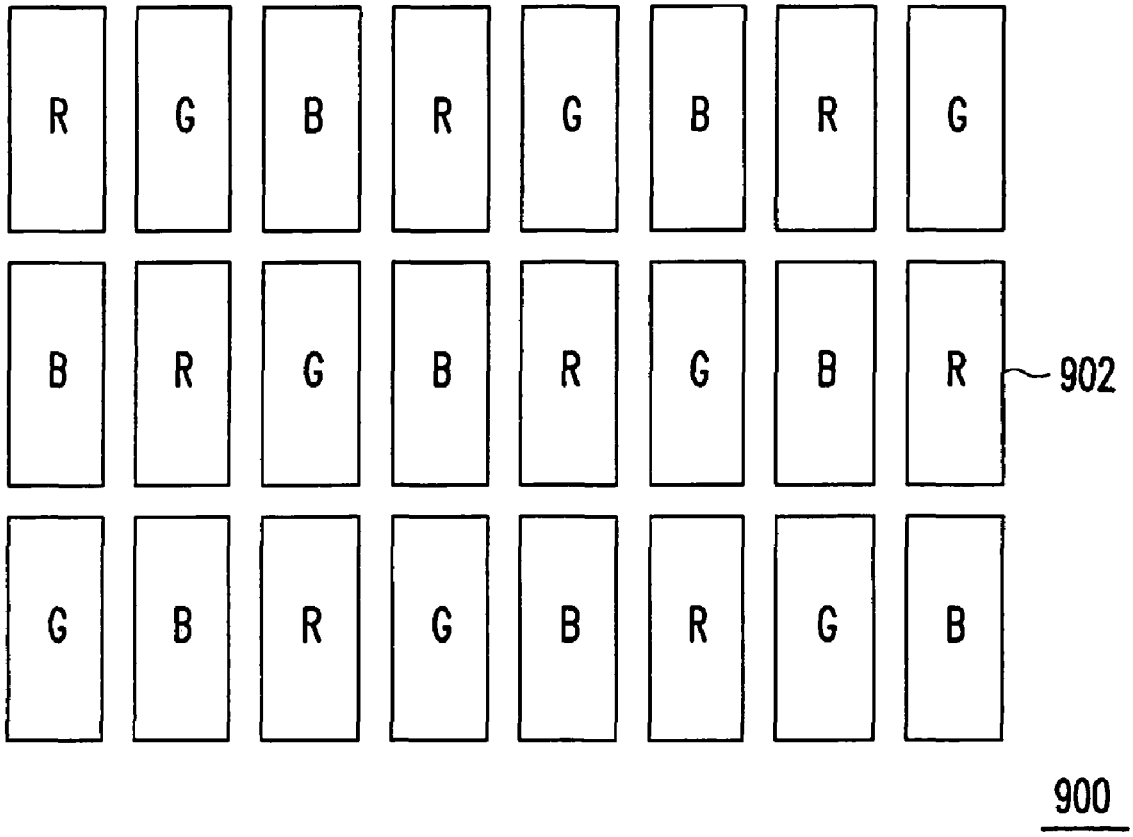
FIG. 7 schematically shows a display apparatus according to an embodiment of the present invention.

Definitely, various electron emission light-emitting devices mentioned above may also be applied in a display apparatus. FIG. 7 shows a display apparatus according to an embodiment of the present invention. Referring to FIG. 7, each display pixel 902 of a display apparatus 900 is constituted by an electron emission light-emitting device, such that a plurality of display pixels 902 forms a display frame, for displaying the static or dynamic picture. The electron emission light-emitting devices are used as the display pixels 902, so the electron emission light-emitting devices, for example, adopt fluorescent layers capable of emitting red, green, and blue lights to form red display pixels R, green display pixels G, and blue display pixels B, thereby achieving a full color display effect.

Figure 8:
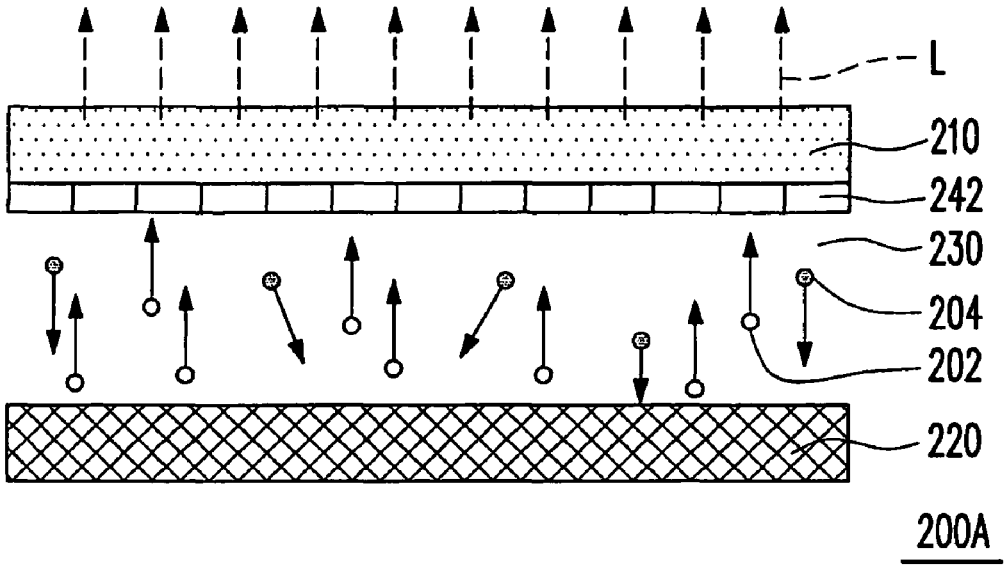
FIGS. 8 to 10 schematically show electron emission light-emitting devices according to other embodiments of the present invention.

Further, the fluorescent layer may be designed to have a single-layered structure to generate lights of identical frequencies, or a lamination structure or several regions of different fluorescent light materials, for generating lights of different frequencies. FIG. 8 shows a light source apparatus according to an embodiment of the preset invention. Referring to FIG. 8, a light-emitting device 200A is, for example, based on the structure of FIG. 2, and a fluorescent layer 242 is, for example, composed of a variety of fluorescent light materials, for generating a mixture of lights with respective frequencies.

Figure 9:
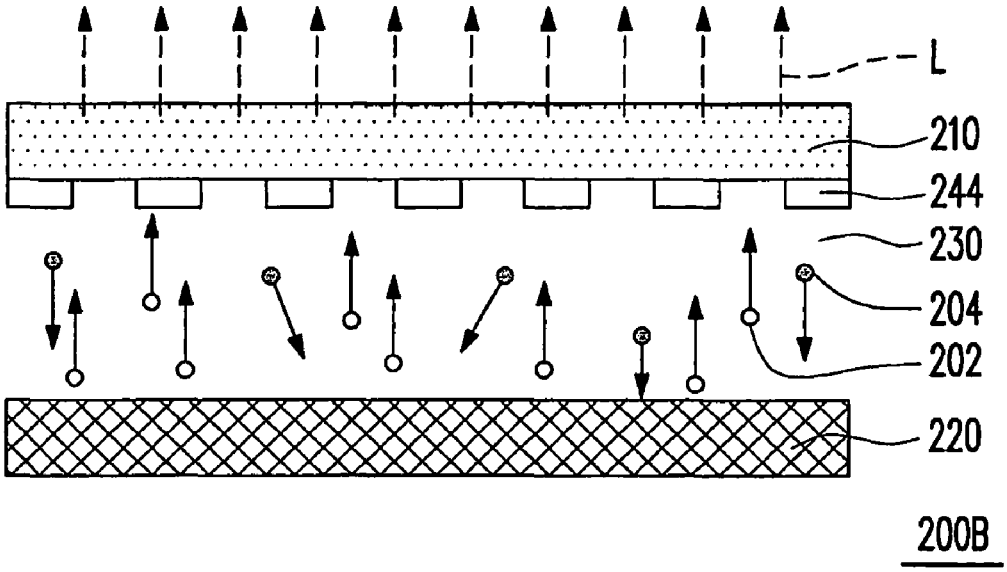

Further, the fluorescent layer may also be composed of separated regions, as shown in FIG. 9. In this embodiment, a fluorescent layer 244 of a light-emitting device 200B is composed of several blocks each capable of emitting lights of identical frequencies or of respectively corresponding frequencies.

Figure 10:
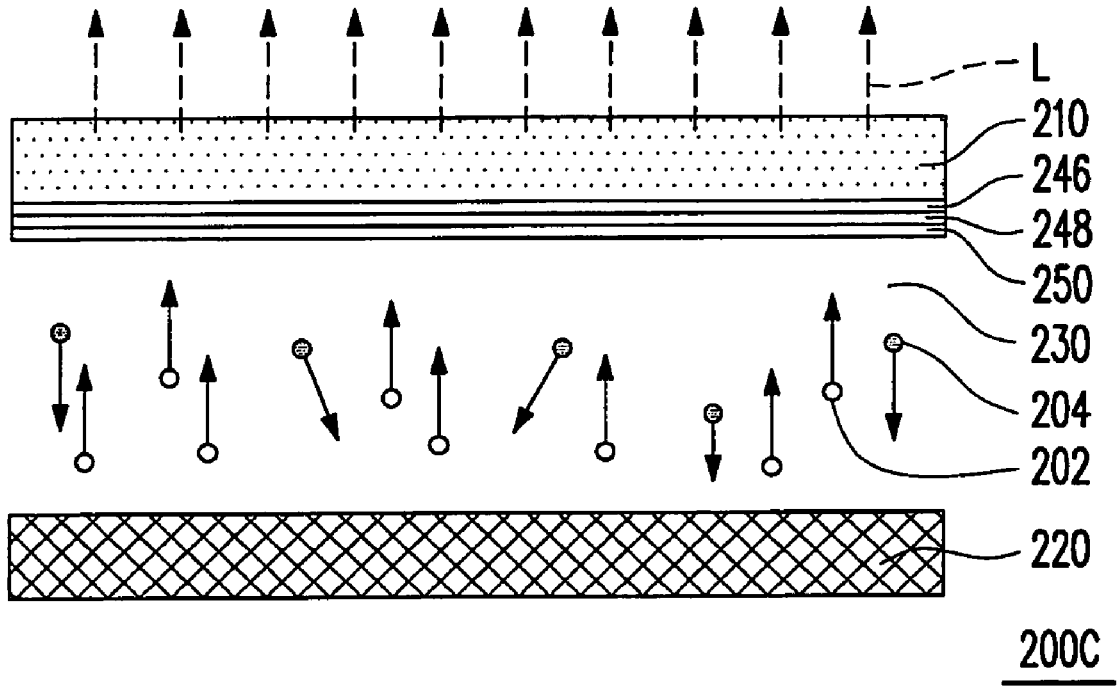

Also, according to the design of the fluorescent layer, a light-emitting device 200C is achieved by laminating the fluorescent layers of different frequencies, as shown in FIG. 10. For example, a lamination composed of red, green, and blue fluorescent layers 246, 248, 250 can emit a white light after light mixing, which is also one of the variations of the present invention. Furthermore, for example, different fluorescent light materials may be mixed to form a fluorescent mixed layer.

In addition, the aforementioned several embodiments can form different combinations and variations depending on the requirements of practical design.

According to the verification of an embodiment of the present invention, as for a 90 mm×110 mm spatial plane, the surface light source is disposed approximately at a middle position of the bottom, and five measuring points are, for example, an upper left corner (point 1), an upper right corner (point 2), a lower right corner (point 3), a lower left corner (point 4), and a middle point (point 5) in sequence, and the brightness performance obtained at the measuring points is listed in Table 1. Table 1 shows that the present invention indeed achieves the design of a light source. The point 5 is located right in front of the light source and is close to the light source, and the brightness at the point 5 is highest. The points 3 and 4 are located at the bottom and at two sides of the light source, and thus the brightness at the points 3 and 4 is lowest. The light emission uniformity calculated by, for example, Min/Max, also achieves 2790/3700=0.754.

TABLE 1

| Gas pressure | Point 1 | Point 2 | Point 3 | Point 4 | Point 5 | Uniformity |
|---|---|---|---|---|---|---|
| 1.2E−02 | 3480 | 3550 | 2790 | 2790 | 3700 | 0.754 |

In view of the above, the electron emission light-emitting device provided by the present invention and the light source apparatus and display apparatus using the device have characteristics of power-saving, high light-emitting efficiency, short response time, easy to fabricate, and environmental-friendly (mercury free), thus providing another option of the light source apparatus and display apparatus on the market. As compared with the conventional light-emitting structure, the electron emission light-emitting device provided by the present invention has a simple structure, in which the cathode as long as being a planar structure can operate normally, and the related secondary electron source material layer or induced discharge structure is optional and not essential devices. Further, the electron emission light-emitting device of the present invention does not need the ultra high vacuum packaging, thus simplifying the production process and facilitating the mass production.

On the other hand, the cathode of the electron emission light-emitting device of the present invention may be a metal, so the reflectivity is improved and the brightness and light-emitting efficiency are also improved. Moreover, the wavelengths of the lights emitted by the electron emission light-emitting device vary depending on the types of the fluorescent layers, and the light sources of different wavelength ranges may be designed depending to different usages of the light source apparatus or the display apparatus. In addition, the electron emission light-emitting device of the present invention may be designed into a planar light source, a linear light source, or a spot light source, so as to meet different usage requirements of the display apparatus and the light source apparatus (e.g., backlight modules or illumination lamps).

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electron emission light-emitting device, comprising:

a substrate;

at least one cathode structure, disposed on the substrate with direct contact;

at least one anode structure, disposed on the substrate with direct contact;

a fluorescent layer, disposed on the substrate with direct contact and located between the at least one cathode structure and the at least one anode structure; and a low-pressure gas layer, filled between the at least one cathode structure and the at least one anode structure, for inducing the cathode structure to emit electrons uniformly.

2. The electron emission light-emitting device according to claim 1, wherein the low-pressure gas layer comprises an electron mean free path allowing at least sufficient amount of electrons to directly impinge the fluorescent layer under an operation voltage.

3. The electron emission light-emitting device according to claim 1, wherein a gas pressure of the low-pressure gas is between $8\times10^{-1}$ torr and $10^{-3}$ torr.

4. The electron emission light-emitting device according to claim 1, wherein the fluorescent layer is located on a surface of the anode.

5. The electron emission light-emitting device according to claim 1, wherein the fluorescent layer after being impinge by the electrons generates a visible light, an infrared light, or UV light.

6. The electron emission light-emitting device according to claim 1, wherein the fluorescent layer is a single-layered structure, for generating lights of identical frequencies.

7. The electron emission light-emitting device according to claim 1, wherein the fluorescent layer comprises a plurality of fluorescent regions, for generating lights of corresponding frequencies respectively.

8. The electron emission light-emitting device according to claim 1, wherein the fluorescent layer is a lamination structure or a mixture structure comprising multiple different fluorescent materials.

9. The electron emission light-emitting device according to claim 1, wherein the anode structure comprises a transparent conductive material.

10. The electron emission light-emitting device according to claim 9, wherein the transparent conductive material comprises ITO, IZO, FTO, or TCO.

11. The electron emission light-emitting device according to claim 1, wherein at least one of the anode structure and the cathode structure is made of a metal or a conductive material.

12. The electron emission light-emitting device according to claim 1, wherein the anode structure and the cathode structure are located at a same side of a substrate.

13. The electron emission light-emitting device electron emission light-emitting device according to claim 1, wherein the low-pressure gas layer is provided with sufficient conductivity after a gas of the low-pressure gas layer is ionized.

14. The electron emission light-emitting device according to claim 1, wherein a gas of the low-pressure gas layer is inert gas, $H_2$, $CO_2$, $O_2$, or air.

15. The according to claim 1, wherein the at least one cathode structure and the at least one anode structure form a plurality of electrode pairs for emitting lights.

16. The electron emission light-emitting device according to claim 1, wherein the cathode structure comprises a secondary electron source material layer.

* * * * *